US011932507B2

(12) United States Patent
Corread et al.

(10) Patent No.: US 11,932,507 B2
(45) Date of Patent: Mar. 19, 2024

(54) STATION AND METHOD FOR RECEIVING SHEET ELEMENTS FOR A MACHINE FOR MANUFACTURING PACKAGING

(71) Applicant: Bobst Lyon, Villeurbanne (FR)

(72) Inventors: Thibault Corread, Lyons (FR); Denis Busa, Caluire-et-Cuire (FR); Claude Convert, Beynost (FR)

(73) Assignee: BOBST LYON, Villeurbanne (FR)

( * ) Notice: Subject to any disclaimer, the term of this patent is extended or adjusted under 35 U.S.C. 154(b) by 270 days.

(21) Appl. No.: 17/310,412

(22) PCT Filed: Feb. 24, 2020

(86) PCT No.: PCT/EP2020/025087
§ 371 (c)(1),
(2) Date: Jul. 30, 2021

(87) PCT Pub. No.: WO2020/173604
PCT Pub. Date: Sep. 3, 2020

(65) Prior Publication Data

US 2022/0089400 A1 Mar. 24, 2022

(30) Foreign Application Priority Data

Feb. 26, 2019 (FR) ..... 1901940

(51) Int. Cl.
*B65H 31/30* (2006.01)
*B65H 31/10* (2006.01)
*B65H 31/32* (2006.01)

(52) U.S. Cl.
CPC ..... *B65H 31/3054* (2013.01); *B65H 31/10* (2013.01); *B65H 31/32* (2013.01); *B65H 2701/1762* (2013.01)

(58) Field of Classification Search
CPC .... B65H 31/3054; B65H 31/10; B65H 31/32; B65H 2701/1762
(Continued)

(56) References Cited

U.S. PATENT DOCUMENTS 4,189,270 A * 2/1980 Ehrlich ..... B65H 31/3054 271/189
5,160,129 A 11/1992 Siriporn et al.
(Continued)

FOREIGN PATENT DOCUMENTS

CN 101885425 A 11/2010
CN 103287904 A 9/2013
(Continued)

OTHER PUBLICATIONS

International Search Report dated Jun. 4, 2020 in counterpart International Patent Application No. PCT/EP2020/025087 (2 pages in English, 2 pages in French).

*Primary Examiner* — Gregory W Adams
(74) *Attorney, Agent, or Firm* — Bookoff McAndrews PLLC

(57) ABSTRACT

The invention relates to a station for receiving sheet-form elements and discharging bundles of sheet-form elements for a packaging manufacturing machine, comprising:

an arrangement for feeding sheet-form elements successively one after the other (8), a lift table (16), mobile in a vertical direction, comprising several continuous conveyor belts (17) extending in a longitudinal horizontal direction, for receiving the sheet-form elements in bundle form, an output conveyor (14), for discharging the sheet-form elements in bundle form, and a separator (21), mobile in the vertical direction, comprising several reception arms (22) being deployed in the longitudinal horizontal direction, for transiently (Continued)

receiving the sheet-form elements in bundle form, the arms (22) being disposed so as to be able to cross in the vertical direction without interacting with the belts (17) of the table (16).

9 Claims, 6 Drawing Sheets

(58) Field of Classification Search
USPC ..... 414/790, 790.8; 271/218
See application file for complete search history.

(56) References Cited

U.S. PATENT DOCUMENTS

| | | | | |
|---|---|---|---|---|
| 5,545,001 | A * | 8/1996 | Capdeboscq | B65H 31/32 414/794.8 |
| 5,613,673 | A | 3/1997 | Roberts et al. | |
| 5,820,539 | A * | 10/1998 | Strahm | B65H 45/107 414/789.5 |
| 6,695,302 | B1 * | 2/2004 | Lamothe | B65H 33/08 271/9.12 |
| 6,752,586 | B2 * | 6/2004 | Baumann | B65H 31/32 271/218 |
| 6,988,721 | B2 * | 1/2006 | Ingelsten | B65H 31/32 271/9.12 |
| 7,402,130 | B1 | 7/2008 | Sjostedt et al. | |
| 7,500,819 | B2 * | 3/2009 | Nielsen | B65H 29/38 414/790.7 |
| 2013/0140763 | A1 | 6/2013 | Jakob | |

FOREIGN PATENT DOCUMENTS

| | | | |
|---|---|---|---|
| EP | 0501213 | A1 | 9/1992 |
| EP | 0666234 | A1 | 8/1995 |
| EP | 3378811 | A1 | 9/2018 |
| JP | S63315458 | A | 12/1988 |
| JP | H03115056 | A | 5/1991 |
| JP | H0543105 | A | 2/1993 |
| JP | H07228410 | A | 8/1995 |
| JP | 2000103529 | A | 4/2000 |
| JP | 2001139163 | A | 5/2001 |
| JP | 2006069034 | A | 3/2006 |
| JP | 2008093997 | A | 4/2008 |
| JP | 4774350 | B2 | 9/2011 |
| JP | 3211835 | U | 7/2017 |
| TW | 464636 | B | 11/2001 |

* cited by examiner

FIG. 1
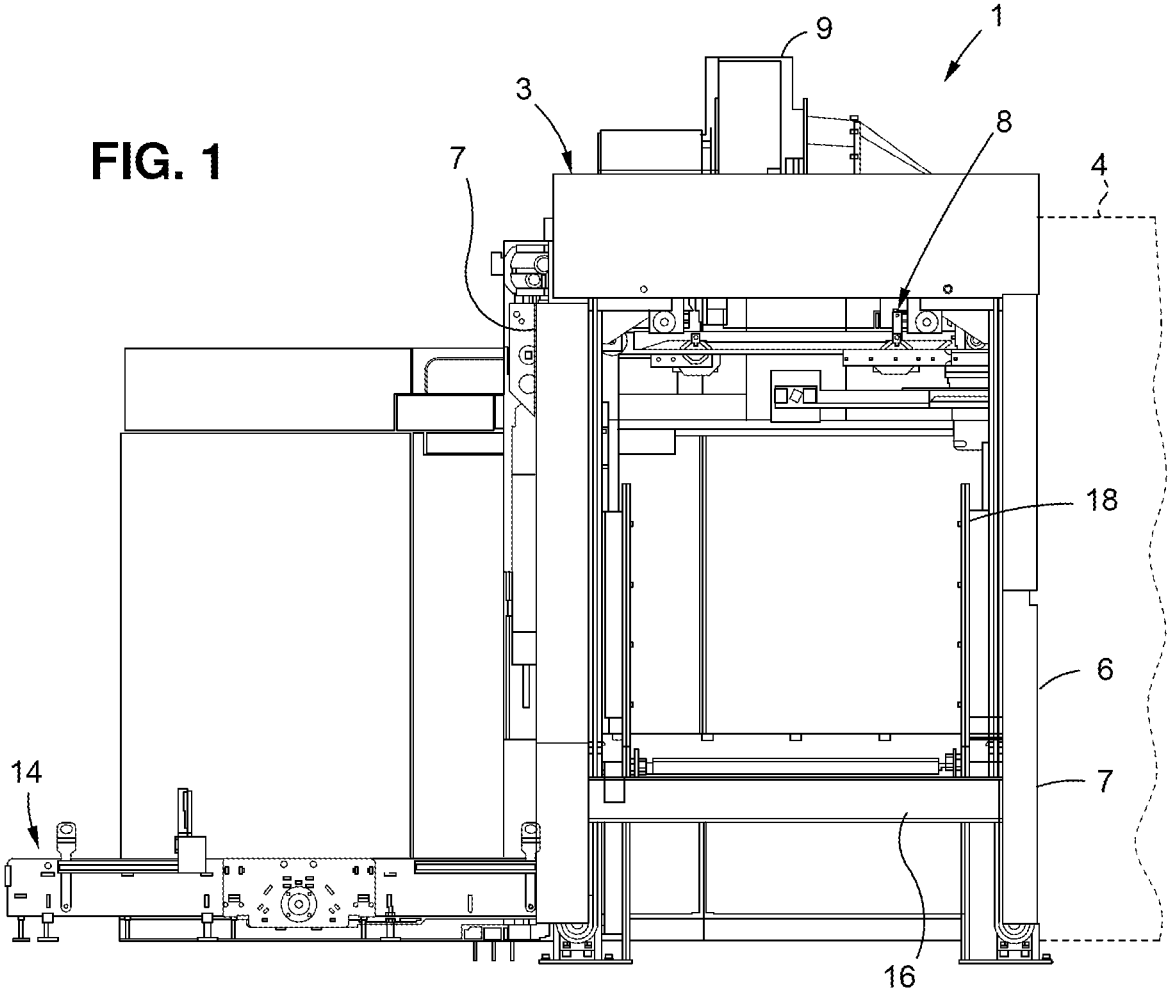
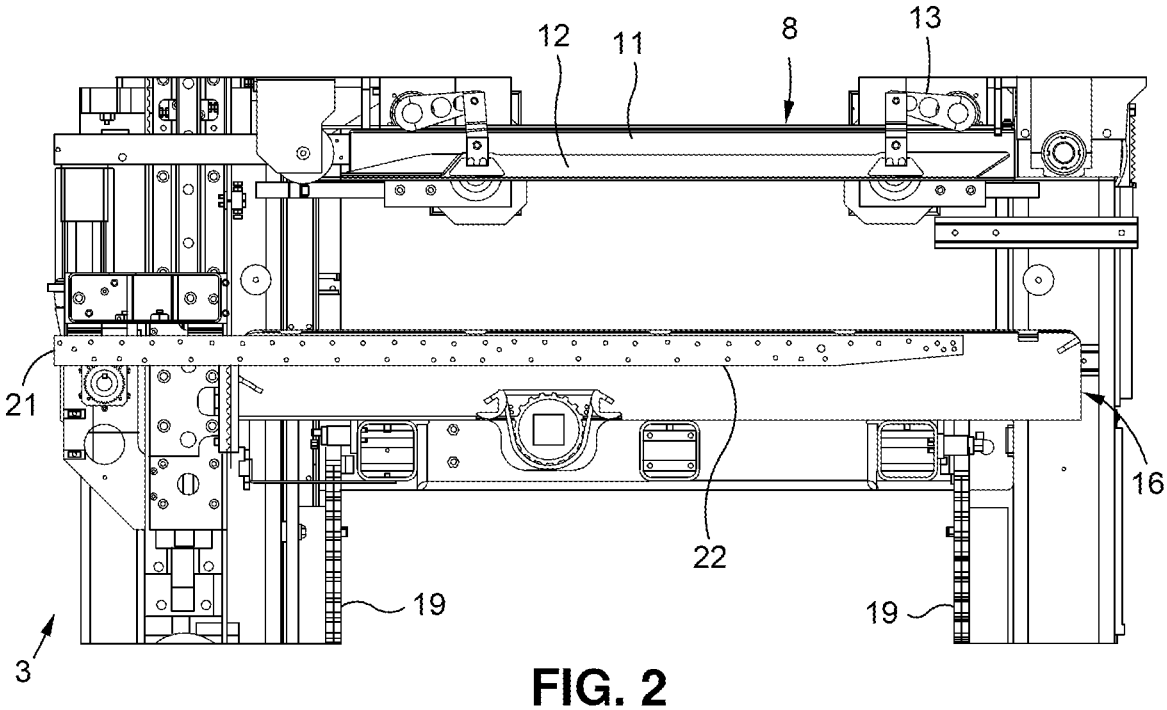
FIG. 2

STATION AND METHOD FOR RECEIVING SHEET ELEMENTS FOR A MACHINE FOR MANUFACTURING PACKAGING

CROSS-REFERENCE TO RELATED APPLICATION(S)

This application is a National Stage under 35 U.S.C. § 371 of International Application No. PCT/EP2020/025087, filed on Feb. 24, 2020, which claims priority to French Patent Application No. 1901940, filed on Feb. 26, 2019, the contents of all of which are incorporated by reference in their entirety.

The invention relates to a station for receiving sheet-form elements and discharging bundles of sheet-form elements for a packaging manufacturing machine. The invention relates also to a machine for manufacturing packaging from sheet-form elements, comprising a station for receiving, stacking and discharging bundles of sheet-form elements. The invention relates also to a method for receiving sheet-form elements for a packaging manufacturing machine.

A packaging manufacturing machine is commonly employed in order to handle the making of boxes or cases of cardboard from sheet-form elements, for example in the form of sheets of corrugated cardboard. The sheet-form elements are introduced successively into the machine, advance continuously from upstream to downstream in the longitudinal drive direction. They are automatically printed by flexography, cut and scored, so as to form case layups. At the output of the machine, the sheet-form elements are received and stacked, and the bundles obtained are then discharged. A receiving station is responsible for receiving the sheet-form elements and for making up bundles of sheet-form elements.

STATE OF THE ART

The document EP0666234 describes a station for stacking, separating and discharging bundles of sheet-form elements. The station comprises a vertically mobile lift table, receiving sheet-form elements that drop to be stacked. The table descends progressively to the level of an output conveyor, recovering and discharging a bundle of sheet-form elements after the formation thereof. A separator is displaced vertically and horizontally. After the formation of a bundle, the separator comes above the lift table and then is interposed to support the sheet-form elements of the next bundle. The lift table then transfers the bundle that has just been formed, to the output conveyor which discharges the bundle. The separator is then retracted and the lift table can then recover the sheet-form elements of the next bundle.

Such a station presents drawbacks. First of all, the sheet-form element at the bottom of the bundle is very often damaged when the separator is retracted. Furthermore, the separator exhibits a certain inertia. Its displacement during a cycle proves difficult to perform at a speed compatible with the rates of stacking necessary for the sheet-form elements. Such a separator can also prove incompatible with some modes of transverse alignment of the sheet-form elements.

The document EP 0501213 describes a station for stacking, separating and discharging bundles of sheet-form elements. The station comprises means for feeding sheet-form elements, retractable supports forming a temporary stacking store, placed above a bundle discharging device.

Such a station presents drawbacks. In particular, the first sheet-form element arriving in the stacking store will be in contact with, and be damaged by, the retractable supports.

Furthermore, because of the heightwise-fixed position of the retractable supports, the temporary stacking store will be more rapidly saturated with sheet-form elements arriving at high rate, which limits the general productivity of the printing or transformation line.

SUMMARY OF THE INVENTION

The invention aims to resolve one or more of these drawbacks. A main objective of the present invention consists in developing a station for receiving sheet-form elements that makes it possible to avoid the dropping of sheet-form elements and of bundles. A second objective is to produce a packaging manufacturing machine comprising a station for receiving sheet-form elements and discharging bundles of sheet-form elements, installed at the downstream output of the machine. Yet another objective is that of succeeding in implementing a method for receiving sheet-form elements for a packaging manufacturing machine.

According to one aspect of the present invention, a station for receiving sheet-form elements and discharging bundles of sheet-form elements for a packaging manufacturing machine is characterized in that it comprises:

- an arrangement for feeding sheet-form elements successively one after the other,
- a lift table, mobile in a vertical direction, comprising several continuous conveyor belts, extending in a longitudinal horizontal direction, for receiving the sheet-form elements in bundle form,
- an output conveyor, for discharging the sheet-form elements in bundle form, and
- a separator, mobile in the vertical direction, comprising several reception arms being deployed in the longitudinal horizontal direction, for transiently receiving the sheet-form elements in bundle form, the arms being disposed so as to be able to cross in the vertical direction without interacting with the continuous conveyor belts of the lift table.

In other words, with the separator, the bundle is received transiently and transferred without dropping from the separator to the lift table by virtue of the vertical crossing thereof. The conveyor belts of the lift table are disposed alternately, so as to be able to cross with the arms of the separator. The arms of the separator constitute a grid for receiving the bundle currently being formed, and are capable of passing between the conveyor belts of the lift table. The bundle is thus transferred seamlessly and without being dropped from the arms of the separator to the belts of the lift table, by virtue of the vertical crossing thereof.

A sheet-form element is defined, by way of non-exhaustive example, as being made of a material such as paper, flat cardboard, corrugated cardboard, laminated corrugated cardboard, flexible plastic, or even other materials.

According to a particular feature, the arms of the separator can be capable of being displaced in the longitudinal horizontal direction, from downstream to upstream, so as to be able to position them above the lift table, and from upstream to downstream, so as to be able to retract them out of the travel of the lift table.

According to a particular feature, the separator can preferentially comprise:

- a support, the support being mounted to slide in a vertical direction,
- at least one arm, the arm or arms being mounted and being capable of being displaced in the longitudinal horizontal direction relative to the support, the displacement of the arm or arms modifying the length of the arm or arms overhanging relative to the support on a first side in the longitudinal horizontal direction, and a drive system for displacing the arm or arms in the longitudinal horizontal direction, the drive system being configured to simultaneously drive the arms in displacement in the longitudinal horizontal direction and keep another of the arms retracted in its longitudinal position.

According to a particular feature, the separator thus comprises first of all a vertically mobile support. And, the reception arms of the separator are driven by a longitudinal horizontal translational movement, separately from the movement of the support.

According to a particular feature, and favourably, the lift table can be mobile between a high position under the arrangement for feeding the sheet-form elements and a low position in a plane similar to the plane of the bundle-discharging output conveyor. Given that the lift table is situated in its position of maximum height directly under the arrangement for feeding the sheet-form elements, the sheet-form elements will arrive and descend directly onto the lift table.

According to a particular feature, the belts of the lift table can advantageously be capable of driving the bundle from upstream to downstream on the output conveyor.

According to a particular feature, and preferably, the output conveyor can comprise at least one belt, which is capable of driving the bundle from upstream from the lift table to downstream.

According to another aspect of the invention, a packaging manufacturing machine is characterized in that it comprises a station for receiving sheet-form elements and discharging bundles of sheet-form elements, installed at the downstream output of the machine, and having one or more technical features described and claimed hereinbelow.

According to yet another aspect of the invention, a method for receiving sheet-form elements for a packaging manufacturing machine is characterized in that it comprises the steps of:

successively depositing sheet-form elements on a vertically mobile table, so as to form a first bundle of sheet-form elements;

vertically lowering the mobile table vertically with the successively deposited sheet-form elements to end the formation of the first bundle of sheet-form elements;

bringing in a vertically mobile separator above the vertically mobile table;

successively depositing the sheet-form elements on the vertically mobile separator, so as to form a second bundle of sheet-form elements;

horizontally discharging from the vertically mobile table the first bundle formed;

vertically lowering the mobile separator vertically with the successively-deposited sheet-form elements to end the formation of the second packet of sheet-form elements;

vertically raising the mobile table vertically;

having the empty vertically rising vertically-mobile table cross with the vertically lowering vertically-mobile separator, so as to recover the second bundle of sheet-form elements from the vertically mobile separator to the vertically mobile table; and taking the vertically mobile separator out of the travel of displacement of the vertically mobile table.

By virtue of the dynamic operation of the vertically mobile table and of the vertically mobile separator, the bundle is thus transferred seamlessly from the vertically mobile separator which descends to the vertically mobile table which rises.

According to a particular feature, the step of bringing in the vertically mobile separator can preferably be done in the longitudinal horizontal direction from downstream to upstream above the plane of circulation of the sheet-form elements, then in the vertical direction from above the plane of circulation, to below the plane of circulation.

According to a particular feature, the step of taking the vertically mobile separator out can be done favourably in the longitudinal horizontal direction from upstream to downstream.

The invention relates also to the following variants. The person skilled in the art will understand that each of the features of the following variants can be combined independently of the above features, without in any way constituting an intermediate generalization.

BRIEF DESCRIPTION OF THE DRAWINGS

Other features and advantages of the invention will clearly emerge from the description which is given thereof hereinbelow, in an indicative and nonlimiting manner, with reference to the attached drawings, in which:

FIG. 1 represents a side view of the station for receiving sheet-form elements and discharging bundles mounted downstream;

FIG. 2 represents a detailed side view of the station of FIG. 1;

Figure 3:
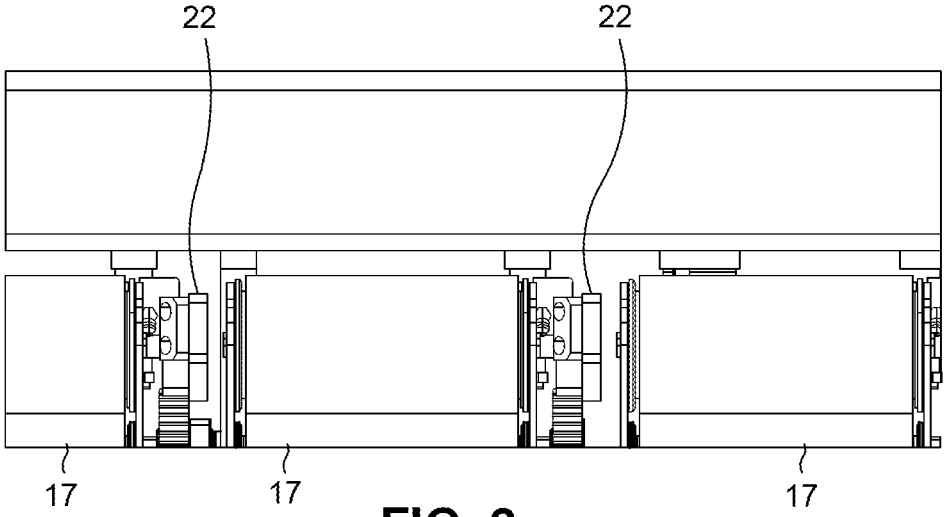
FIG. 3 represents a view along the longitudinal axis of the table and of the separator of the station.

The longitudinal direction is defined as referring to the direction of progress or of driving of the sheet-form elements in the packaging manufacturing machine, in the station for receiving sheet-form elements, along their median longitudinal axis. The transverse direction is defined as being the right-angled direction in a plane horizontal to the direction of progress of the sheet-form elements. The upstream and downstream directions are defined with reference to the direction of displacement of the sheet-form elements, according to the longitudinal direction throughout the packaging manufacturing machine, from the input of the machine to the machine output and the station for receiving sheet-form elements.

DETAILED EXPLANATION OF PREFERRED EMBODIMENTS

As FIG. 1 illustrates, a packaging manufacturing machine, such as a flexography printing machine 1 for sheets of corrugated cardboard 2, comprises a station for receiving sheet-form elements and for discharging bundles of sheet-form elements 3. All of the flexography printing part with, notably, the different groups of printers 4, is represented partially by dashed lines. The receiving station 3 is mounted downstream of the last printer group of the machine 1.

The station 3 comprises a frame 6 with vertical side uprights 7. The station 3 comprises an arrangement for feeding the sheets 8, mounted in the upper part of the frame 6. The arrangement 8 includes notably a suction to create a vacuum 9. The arrangement 8 also comprises conveyor belts 11 and a grid provided with longitudinal bars, the top face of the sheets 2 being in contact with the conveyor belts 11. The sheets 2 which are printed arrive one after the other from upstream to downstream in a plane of circulation by being driven upstream of the station 3 by rollers and a vacuum suction (not visible), referred to as ceiling-mounted, then they are released at the arrangement 8.

The arrangement 8 comprises a sheet precipitating device 12 mounted on the grid to separate the sheets 2 from the conveyor belts 11 and have them drop (see FIG. 2). The sheet precipitating device 12 comprises, for example, a mechanism of the type with crank connecting rod 13 actuated sequentially according to the arrival of the sheets 2.

The station 3 comprises an output conveyor 14 in the form of a belt or one or more conveyor belts 15, transporting the final bundle form the upstream of the station 3 to the downstream output.

The station 3 comprises a lift table 16 that is mobile in the vertical direction. The table 16 comprises several continuous conveyor belts 17 extending in a longitudinal horizontal direction. The belts 17 are driven by an appropriate motor and transport the final bundle 18 from upstream to the output conveyor 14. The table 16 rises and descends by being driven using a motor and chains 19.

The station 3 comprises a separator 21, which comprises several reception arms 22 being deployed in the longitudinal horizontal direction. The arms 22 are longitudinally mobile from upstream to downstream and vice versa. Some arms 22 can remain in retracted position in downstream position, this for example being dependent on the dimension of the sheets 2 forming the bundle 18. The separator 21 rises and descends in the vertical direction by being driven using a motor and toothed belts.

According to the invention, when the table 16 crosses the separator 21, the reception arms 22 are inserted between the belts 17, without their being any interaction between the arms 22 and belts 17 (see FIG. 3).

The method for receiving sheet-form elements 2 and discharging bundles of sheet-form elements 18 for the packaging manufacturing machine is illustrated in FIGS. 4 to 15.

In a first step of the method (FIGS. 4 and 5), sheet-form elements, in the form of sheets 2, arriving successively (arrow F in FIG. 5) from the flexography printing part 4 of the flexography printing machine 1, are deposited successively on the vertically mobile table 16, so as to form a first bundle of sheets 23.

In a second step of the method (FIGS. 5 and 6), the table 16 with the successively deposited sheets is lowered vertically (arrow DT in FIG. 5), to end the formation of the first bundle of sheets 23.

In a third step of the method (FIGS. 5 and 6), the vertically mobile separator 21 is brought in (arrow ES in FIG. 5), with several of its arms 22 being inserted above the table 16. In its starting waiting position (see FIG. 5), the separator 21 with its arms 22 is positioned above the arrangement for feeding the sheets 8 and sheet precipitating device 12. In its functional position of arrival (see FIG. 6), the separator 21 with its arms 22 is positioned above the first bundle of sheets 23 under the arrangement for feeding the sheets 8 and the sheet precipitating device 12.

In a fourth step of the method (FIGS. 6 to 14), the sheets 2 arriving successively (arrow F in FIGS. 6 and 7) from the flexography printing part 4 of the flexography printing machine 1 are deposited successively on the separator 21, and more specifically on its arms 22, so as to form a second bundle of sheets 24.

In a fifth step of the method (FIGS. 6 to 12), the first bundle formed 23 is discharged horizontally (arrows O in FIGS. 6 to 12) from the table 16. The continuous conveyor belts 17 of the table 16 are driven from upstream to downstream. The belt or the conveyor belts 15 of the output conveyor 14 are driven simultaneously from upstream to downstream.

In a sixth step of the method (FIGS. 7 to 9), the separator 21 with the successively deposited sheets is lowered vertically (arrow DS in FIGS. 7 to 9) to end the formation of the second bundle of sheets 24.

Figure 9:
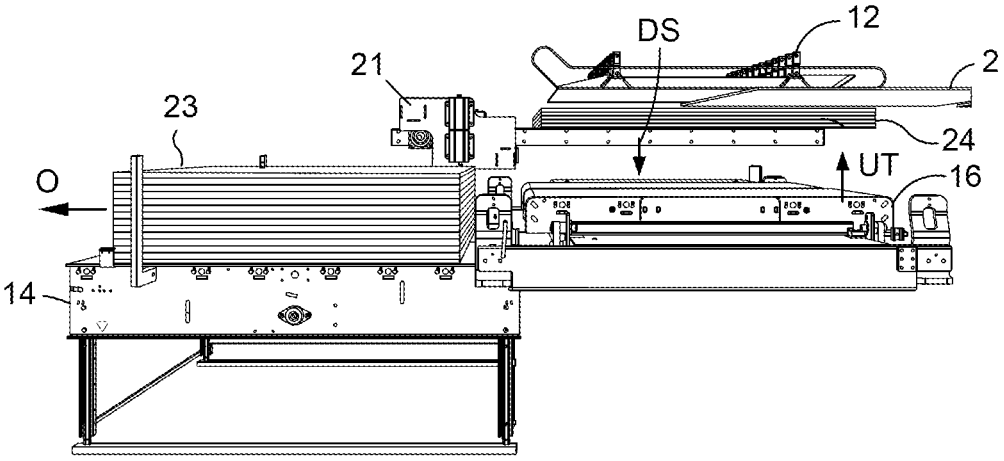
FIG. 9.
Figure 10:
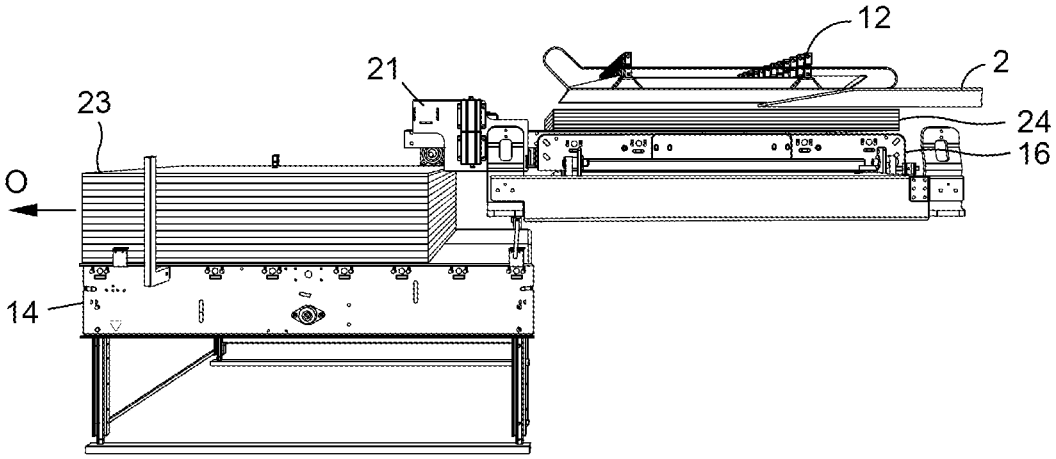
FIG. 10.
Figure 11:
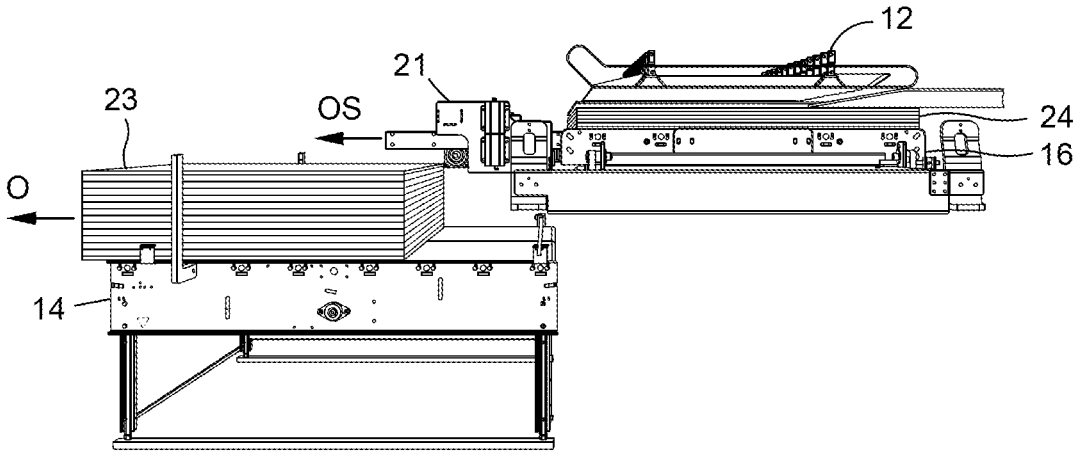
FIG. 11.

In a seventh step of the method (FIG. 9), the table 16 is raised vertically (arrow UT in FIG. 9). The table 16 is empty and no longer bears any bundle.

In an eighth step of the method (FIG. 10), the empty vertically-rising table 16 (UT) is crossed with the vertically lowering separator 21 (DS). This movement of crossing of the continuous conveyor belts 17 of the table 16 with the arms 22 of the separator 21 makes it possible to recover the second bundle of sheets 24 from the separator 21 to the table 16.

Figure 12:
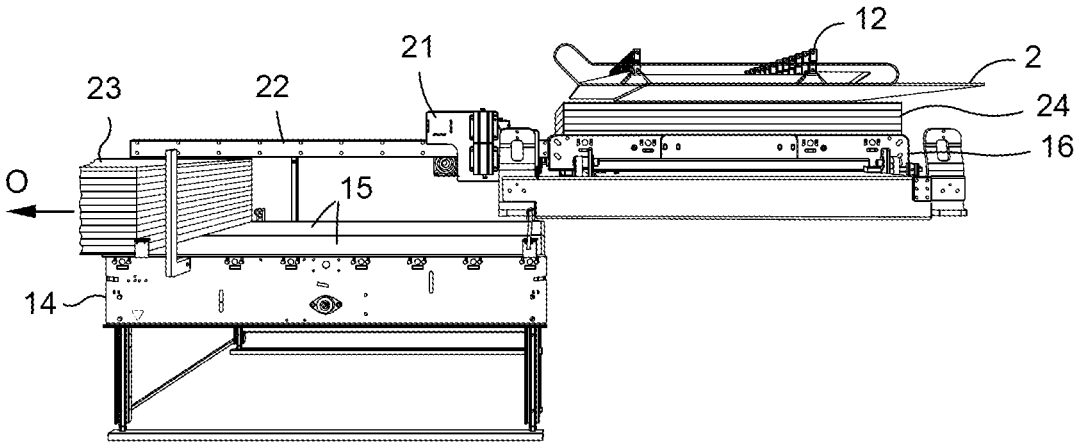
FIG. 12.
Figure 13:
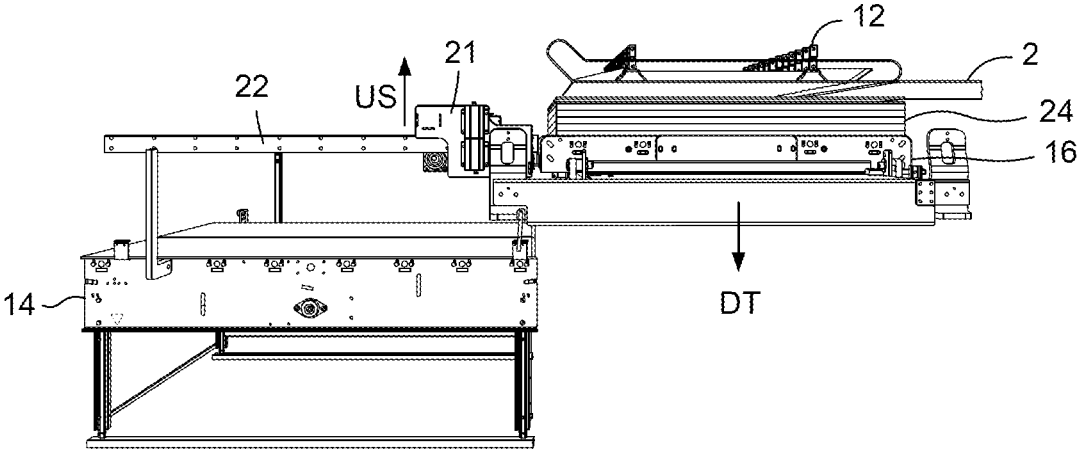
FIG. 13.
Figure 14:
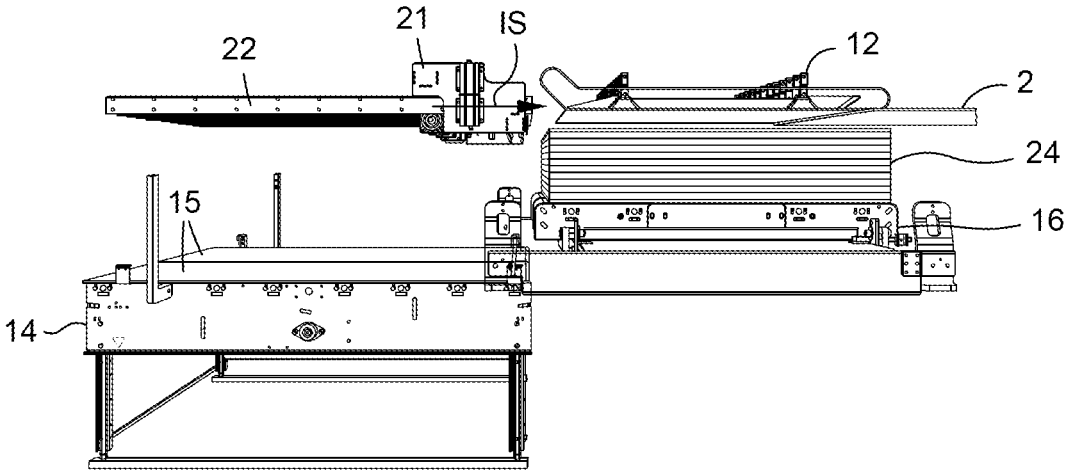
FIG. 14.

In a ninth step of the method (FIGS. 11 and 12), the separator 21 is taken out (arrow OS in FIG. 11) of the travel of displacement of the table 16. The arms 22 of the separator 21 are displaced horizontally from their upstream position crossed at the table 16 (FIG. 10) to a downstream position situated substantially above the output conveyor 14 (FIG. 12).

In another step of the method (FIG. 13), the separator 21 is raised vertically (arrow US in FIG. 13) to the horizontal level of the arrangement for feeding the sheets 8 and of the sheet precipitating device 12.

Figure 4:
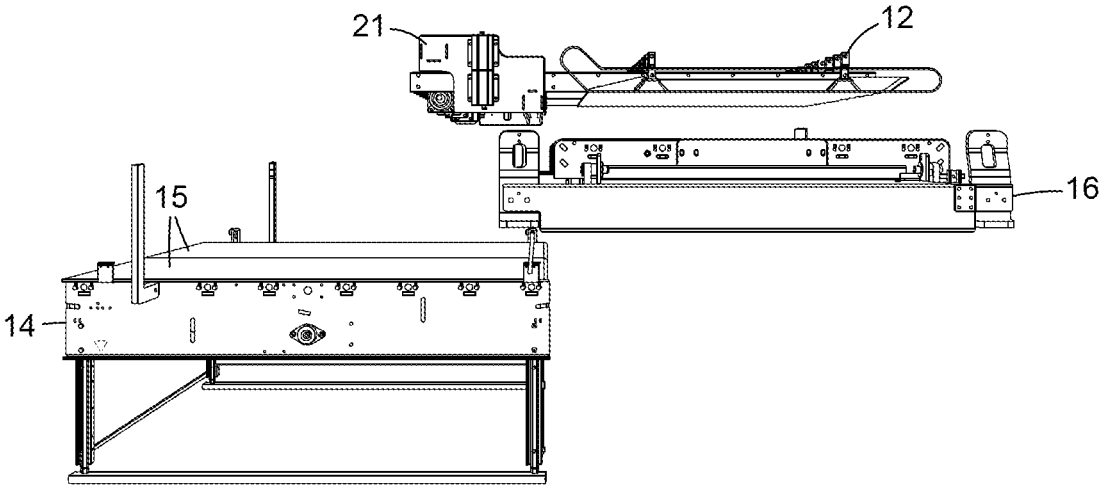
FIG. 4.
Figure 5:
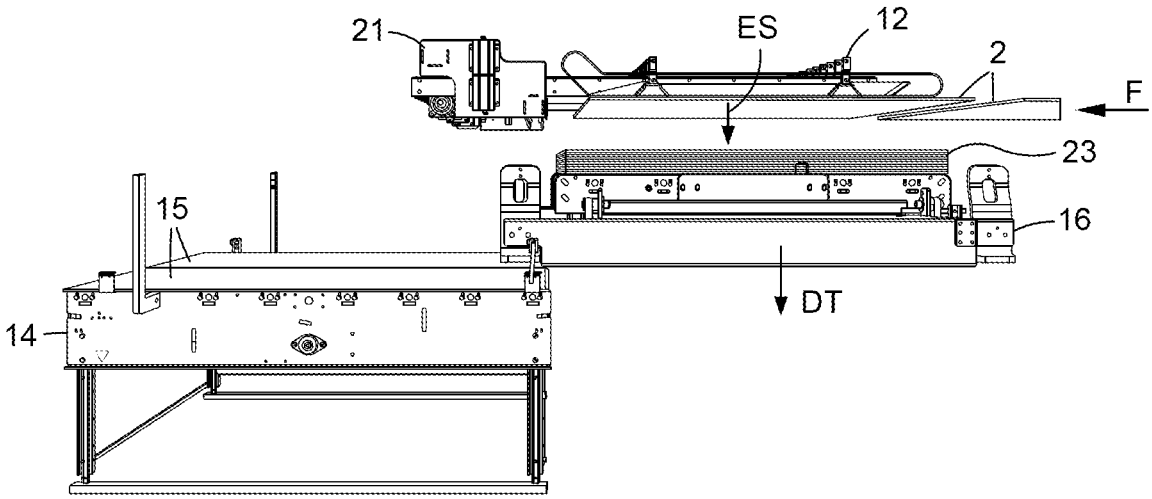
FIG. 5.
Figure 6:
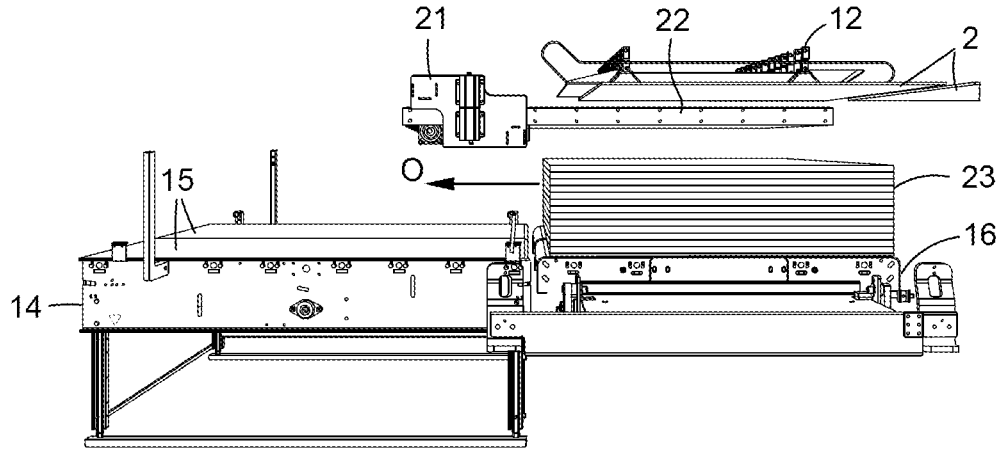
FIG. 6.
Figure 7:
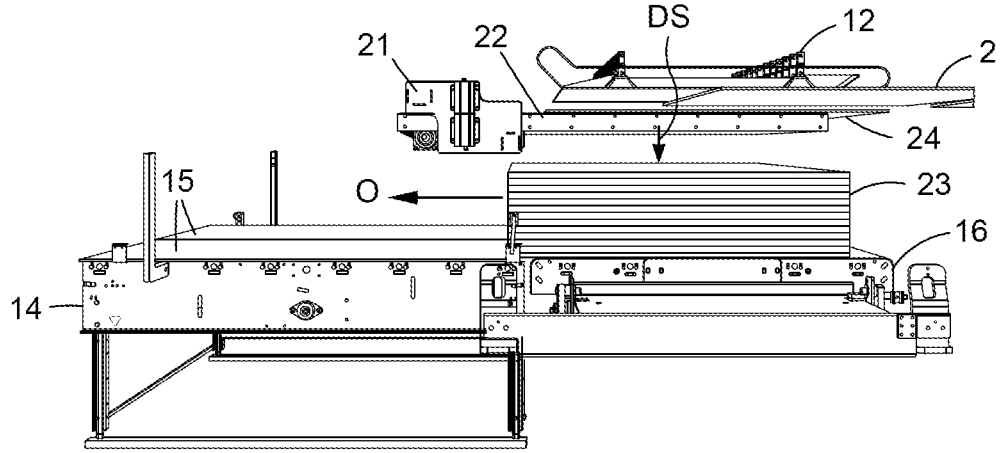
FIG. 7.
Figure 8:
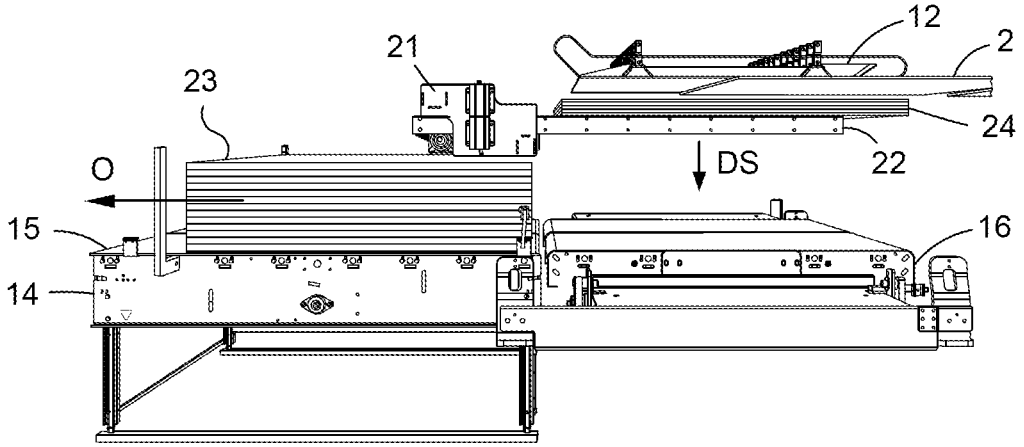
FIG. 8.
Figure 15:
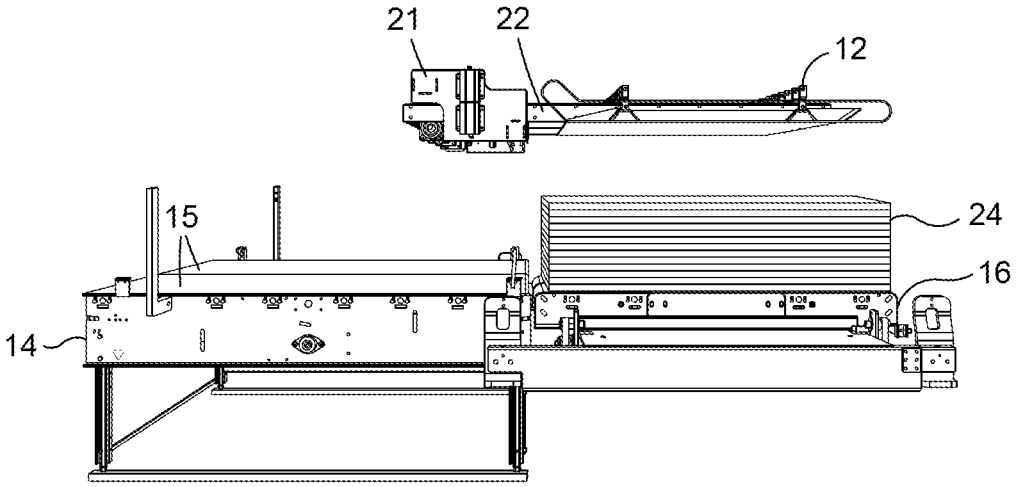
FIG. 15 represent successive views illustrating the method for receiving sheet-form elements.

In a last step of the method (FIGS. 14 and 15), the separator 21 with its arms 22 is repositioned above the arrangement for feeding the sheets 8 and the sheet precipitating device 12. The arms 22 of the separator 21 are displaced (arrow IS in FIG. 14) horizontally from their upstream position situated substantially above the output conveyor 14 (FIGS. 12 to 14) to an upstream waiting position situated substantially above the arrangement for feeding the sheets 8 and the sheet precipitating device 12 (FIG. 15). The upstream waiting position (FIG. 15) is substantially similar to the starting position (FIGS. 4 and 5).

The cycle can thus recommence.

The invention claimed is:

1. A station for receiving sheet-form elements and discharging bundles of sheet-form elements for a packaging manufacturing machine, the station comprising:

an arrangement for feeding sheet-form elements successively one after another, a lift table configured to be mobile in a vertical direction, the lift table comprising a plurality of continuous conveyor belts extending in a longitudinal horizontal direction, for receiving the sheet-form elements in bundle form, an output conveyor configured to discharge the sheet-form elements in bundle form, and a separator configured to be mobile in the vertical direction, the separator comprising a plurality of reception arms being deployed in the longitudinal horizontal direction, for transiently receiving the sheet-form elements in bundle form, the plurality of reception arms being disposed so as to be able to cross in the vertical direction without interacting with the plurality of continuous conveyor belts of the lift table, wherein the separator includes:

a support, mounted to slide in a vertical direction, at least one reception arm of the plurality of reception arms, mounted and configured to be displaced in the longitudinal horizontal direction relative to the support, a displacement of the at least one reception arm modifying an overhanging length relative to the support on a first side in the longitudinal horizontal direction, and a drive system for displacing the at least one reception arm in the longitudinal horizontal direction, the drive system being configured to simultaneously drive the at least one reception arm in displacement in the longitudinal horizontal direction and keep another of the plurality of reception arms retracted in its longitudinal position.

2. The station of claim 1, wherein the plurality of reception arms are configured to be displaced in the longitudinal horizontal direction, from downstream to upstream, so as to position the plurality of reception arms above the lift table, and from the upstream to the downstream, so as to retract the plurality of reception arms out of travel of the lift table.

3. The station of claim 1, wherein the lift table is configured to be mobile between a high position under a feeding arrangement and a low position in a plane similar to a plane of the output conveyor.

4. The station of claim 1, wherein the plurality of continuous conveyor belts of the lift table are configured to drive the bundle form from upstream to downstream on the output conveyor.

5. The station of claim 1, wherein the output conveyor includes at least one belt of the plurality of continuous conveyor belts that is configured to drive the bundle form from upstream from the lift table to downstream.

6. A packaging manufacturing machine comprising the station for receiving sheet-form elements and discharging bundles of sheet-form elements as claimed in claim 1, the station being installed at a downstream output of the packaging manufacturing machine.

7. A method for receiving sheet-form elements for a packaging manufacturing machine, the packaging manufacturing machine comprising:

an arrangement for feeding sheet-form elements successively one after another, a lift table configured to be mobile in a vertical direction, the lift table comprising a plurality of continuous conveyor belts extending in a longitudinal horizontal direction, for receiving the sheet-form elements in bundle form, an output conveyor configured to discharge the sheet-form elements in bundle form, and a separator configured to be mobile in the vertical direction, the separator comprising a plurality of reception arms being deployed in the longitudinal horizontal direction, for transiently receiving the sheet-form elements in bundle form, the plurality of reception arms being disposed so as to be able to cross in the vertical direction without interacting with the plurality of continuous conveyor belts of the lift table, wherein the separator includes:

a support, mounted to slide in a vertical direction, at least one reception arm of the plurality of reception arms, mounted and configured to be displaced in the longitudinal horizontal direction relative to the support, a displacement of the at least one reception arm modifying an overhanging length relative to the support on a first side in the longitudinal horizontal direction, and a drive system for displacing the at least one reception arm in a longitudinal horizontal direction, the drive system being configured to simultaneously drive the at least one reception arm in displacement in the longitudinal horizontal direction and keep another of the plurality of reception arms retracted in its longitudinal position, the method comprising:

successively depositing a first set of sheet-form elements on the lift table, so as to form a first bundle of sheet-form elements;

vertically lowering the lift table with the first set of sheet-form elements to end a formation of the first bundle of sheet-form elements;

bringing in the separator above the lift table;

successively depositing a second set of sheet-form elements on the separator, so as to form a second bundle of sheet-form elements;

horizontally discharging from the lift table the first bundle of sheet-form elements;

vertically lowering the separator with the second set of sheet-form elements to end a formation of the second bundle of sheet-form elements;

vertically raising the lift table;

crossing the lift table with the separator, so as to recover the second bundle of sheet-form elements from the separator to the lift table; and taking the separator out of a travel of displacement of the lift table.

8. The method of claim 7, wherein bringing in the separator above the lift table includes bringing the separator in a longitudinal horizontal direction from downstream to upstream above a plane of circulation of the sheet-form elements, then in a vertical direction from above the plane of circulation, to below the plane of circulation.

9. The method of claim 7, wherein taking the separator out of the travel of displacement of the lift table includes taking the separator in a longitudinal horizontal direction from upstream to downstream.

* * * * *